US011439861B1

(12) United States Patent
Cullen

(10) Patent No.: US 11,439,861 B1
(45) Date of Patent: Sep. 13, 2022

(54) SENSORY TOOL FOR SELF REGULATION, FINE MOTOR DEXTERITY, AND GRIP STRENGTHENING AND METHOD OF USING SAME

(71) Applicant: JustGrowPlay, LLC, Penfield, NY (US)

(72) Inventor: Ellen M. Cullen, Penfield, NY (US)

(73) Assignee: JustGrowPlay, LLC, Penfield, NY (US)

( * ) Notice: Subject to any disclaimer, the term of this patent is extended or adjusted under 35 U.S.C. 154(b) by 173 days.

(21) Appl. No.: 17/068,335

(22) Filed: Oct. 12, 2020

Related U.S. Application Data

(60) Provisional application No. 62/913,343, filed on Oct. 10, 2019.

(51) Int. Cl.
*A63B 21/00* (2006.01)
*A63B 23/16* (2006.01)

(52) U.S. Cl.
CPC ..... *A63B 21/00189* (2013.01); *A63B 23/16* (2013.01); *A63B 21/0004* (2013.01)

(58) Field of Classification Search
CPC ..... A63B 21/00189; A63B 21/0004; A63B 21/4019; A63B 21/4021; A63B 21/4034; A63B 21/4035; A63B 23/16; A63H 33/001
See application file for complete search history.

(56) References Cited

U.S. PATENT DOCUMENTS

| | | | | |
|---|---|---|---|---|
| 7,618,349 | B1 * | 11/2009 | Muderick | A63B 21/028 482/44 |
| 8,764,613 | B1 * | 7/2014 | Barnes | A61H 39/04 482/44 |
| 10,086,641 | B1 * | 10/2018 | Vazquez | B43K 29/00 |
| D865,071 | S * | 10/2019 | Moelmann | D21/468 |
| 11,298,289 | B2 * | 4/2022 | Horowitz | A61H 7/003 |
| 2011/0287900 | A1 * | 11/2011 | Mittelsteadt | A63B 23/14 482/44 |
| 2012/0295767 | A1 * | 11/2012 | Jung | A63B 21/00069 482/49 |
| 2019/0184221 | A1 * | 6/2019 | Minuto | A63B 21/00189 |
| 2020/0269087 | A1 * | 8/2020 | Aguirre, Jr. | A63B 23/18 |

* cited by examiner

*Primary Examiner* — Megan Anderson
(74) *Attorney, Agent, or Firm* — Phillips Lytle LLP; David L. Principe

(57) ABSTRACT

A sensory tool, therapy putty, board, and method for using same. The sensory tool provides for self-regulation, fine motor dexterity, and grip strengthening through a series of imprints and features on its surface(s) that when pressed into resistive putty allows for impressions to be made. When this tool is combined with therapy putty it can be used to strengthen muscles, simulate functional tasks, and provide graded resistance that reinforces the sensorimotor experience to facilitate muscle memory and motor learning.

21 Claims, 5 Drawing Sheets

SENSORY TOOL FOR SELF REGULATION, FINE MOTOR DEXTERITY, AND GRIP STRENGTHENING AND METHOD OF USING SAME

CROSS-REFERENCE TO RELATED APPLICATION

The present invention claims priority benefit of U.S. Provisional Patent Application No. 62/913,343 entitled "Putty Peg and Board" filed Oct. 10, 2019, which is incorporated herein by reference.

FIELD OF THE INVENTION

This disclosure relates to occupational therapy tools and methods, and more particularly to a sensory tool, therapy putty, board, and method for using same.

BACKGROUND ART

Therapy putty can be used to improve grip strength, dexterity, and hand strengthening through finger, hand, and wrist resistive exercises. Therapy putty is a fun and effective occupational therapy tool for finger and hand strengthening. And it makes a fabulous therapeutic fidget and sensory diet tool. When selecting occupational therapy supplies for finger and hand strengthening, therapy putty is a top choice of pediatric therapists, hand rehab experts, and other occupational therapy ("OT") and physical therapy ("PT") professionals.

Useful for rehabilitation, physical or occupational therapy, therapy putty is used for strengthening the hand muscles, improving fine motor skills and relieving stress. Variable resistance putties can be squeezed, pinched, stretched and twisted to effectively work the hand muscles.

Therapy putty may be used to gradually increase hand and grip strength with four distinct levels of resistance putty based on industry standard recovery protocols. Putty resistance types may varying from extra soft to firm, and putty is commonly sold in easy-to-open containers with three ounces of putty each.

Humactive hand putty is available in 8 color-coded resistance levels ranging from X-Soft for the weakest of hands, all the way up through "ULTIMATE"—the highest resistance level on the market. Humactive putties are non-scented and utilize dyes that do not bleed colors, unlike other putty on the market that can stain hands and surfaces.

Therapy putty is designed for strengthening the muscles of the hands and forearms. Physical and occupational therapists, golfers, tennis players, marksman, musicians including guitar players, weight lifters, and the elderly are just a few of the groups that use therapy putty. Putty is suited for those looking to build strength, slow grip-strength loss related to aging, looking for relief from arthritis pain associated with repetitive motion injury, for carpal tunnel pain, or those recovering from surgery. Also useful for sensory therapy, as a tool for attention deficit disorder ("ADD") and attention deficit hyperactivity disorder ("ADHD") sufferers, and for stress relief.

Kids are not entering school with developed fine motor skills due to the decrease in outdoor motor play/coloring experiences and fine motor experience. Teachers are needing to provide these motor experiences for students so they can develop functional hand skills. Kids are motivated to learn by hands on/sensory/tactile play. Kids need muscles developed to access writing and digital apparatus.

There is a need for a specific fine motor dexterity and grasp strengthening tool that can be used with therapy putty. There is also need for methods to create small plugs in putty that can be depressed to enhance learning and self-regulation.

SUMMARY OF THE INVENTION

The present invention meets the above described need by providing a self-regulation, fine motor dexterity and grasp strengthening tool that has a series of imprints and features on its surface(s) that when pressed into resistive putty allows for impressions to be made. When this sensory tool is combined with therapy putty (soft, medium soft putty for the pediatric population; all grades when used with the general population) it can be used to strengthen muscles, simulate functional tasks, and provide graded resistance that reinforces the sensorimotor experience to facilitate muscle memory and motor learning. The distinct impressions the tool makes and the process of using isolated thumb and fingertip/finger pad movements to depress indentations and raised putty surfaces allow for a unique way to simulate functional situations (similar to a pencil making marks on paper, the tool makes marks on putty which then can be used to facilitate learning and growth through optimizing the sensorimotor/motor learning and kinesthetic experience). Most notably the human hand uses the tool to impress markings into resistive putty to allow for putty formations to be made. The tool itself can then be used with and within the putty to perform resistive hand strengthening exercises.

This putty may be used with a putty board to allow for an optimal surface for putty rolling and exercise/use with a putty tool. Use of a nonskid putty board allows for the peg tool and putty to be used in various positions that enhance motor control and proximal stability (at wrist and core musculature) for distal mobility (at distal digit muscles/intrinsic muscles of the hand). A putty board can be used prone, against an upright surface, or under a table (where the user lays on floor and presses putty onto board which is held up against underside of table to promote wrist extension and open web-space when using the peg tool). The putty board could also be used on a desk/table top surface or on an easel at a slanted angle (e.g. 45-60 degrees) to enhance optimal wrist stability and placement to help achieve distal intrinsic hand muscle development (wrist stability as proximal stability for distal digit mobility). The putty board could have impressions on it so that when putty is pressed onto it, impressions are made that can, when combined with putty tool, can be used as therapeutic/fine motor development exercises/activities as well as learning activities.

The tool itself may be small in size for use by children, as small tools for small hands are suited for developing the intrinsic muscles of the hand. Kids start learning with manipulatives (i.e. counters, blocks, etc.) then go to paper. The putty tool may serve as a "go between" between a manipulative and pen/paper or keyboard that reinforces learning. Kids can practice letter formation with the tool as well as practice motor movements, "tapping out sounds" and addition and subtraction by adding "plugs" and depressing "plugs" that all isolate the index finger. Plugs created in putty allow for isolated fingertip flexion movements into the plug to depress them (similar to a keyboard strike movement). Resistance putty creates allows for increased kinesthetic feedback for enhanced motor memory. Pointy tip allows for creation of various shapes into putty optimal for tracing, draw a person, mazes and tactile tracing of impressions with digits. Tracing around circular ring "track" allows for practice of rotary movement needed to perform isolated rotary movements needed to operate a mousepad as well as needed for letter formations.

Use of the tool with therapy putty develops with the use of specific exercises: eye hand coordination, hand dominance, develops and stabilizes arches of the hand, develops the two divisions of precision handling-precision translation and precision rotation, motorically separate sides of the hand and opening and stabilizing the thumb-index web space. In addition, these tools and methods develop the intrinsic muscles of the hand. Another advantage is developing distal finger skills to promote efficient pencil grasp, digital tool use (e.g., of a keyboard, mouse, or stylus) and classroom materials, self-care items, and the use of tools.

The design of the tool, putty and methods of use same, used on a putty board surface with specific surface features for promoting learning and motor skill development, enhance the development of fine motor skills in individuals, particularly young (pre-k; 3-5 yr. old) students. The targeted age group may be ages 3 and up with supervision for ages 3-8. The small version of the tool is specifically designed for use in the preschool (3-5 yr. old population) as this is the optimal age to address development of the intrinsic muscles of the hand. However, the tools and methods described herein can be used (or adapted for use) by any age group. This product could also be used by any individual who has experienced upper extremity trauma/deconditioning/trauma or limiting condition can use this tool as a rehabilitation tool.

DESCRIPTION OF THE PREFERRED EMBODIMENTS

Figure 1:
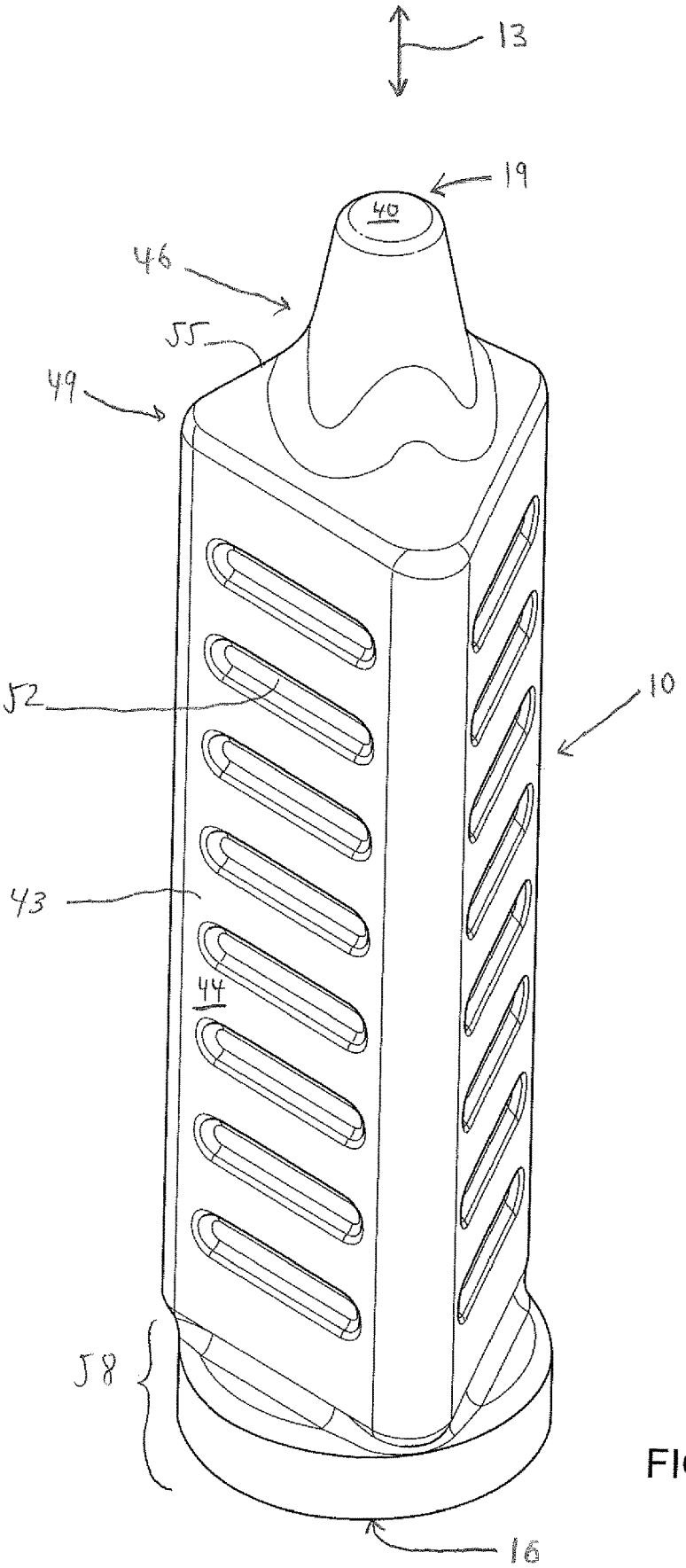
FIG. 1. is a perspective view of the sensory tool of the present invention.
Figure 2:
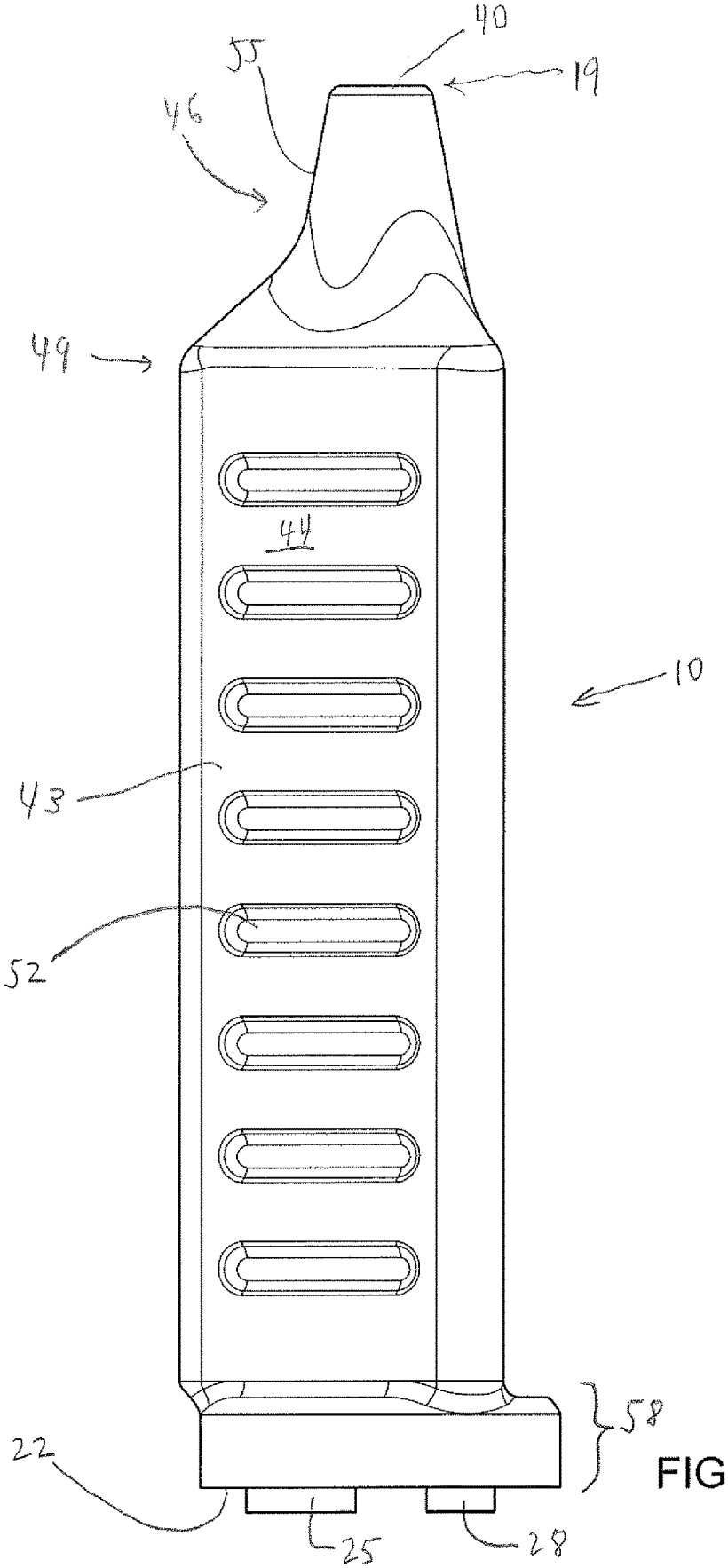
FIG. 2 is a side elevational view of the sensory tool of FIG. 1.
Figure 3:
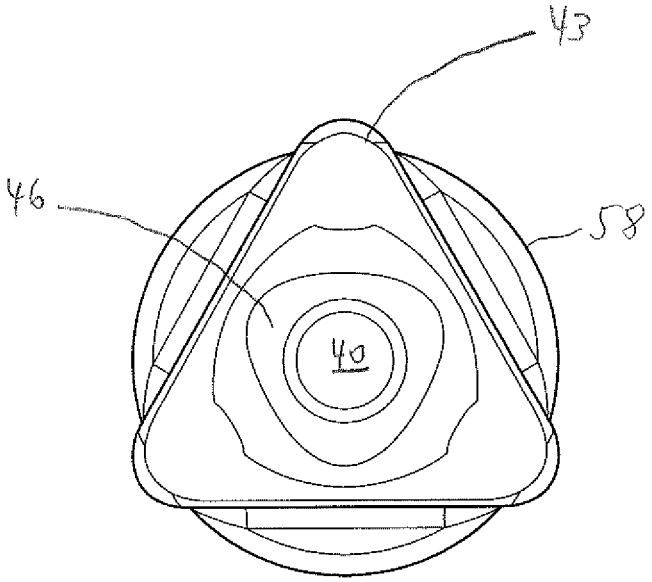
FIG. 3 is a top plan view thereof.
Figure 4:
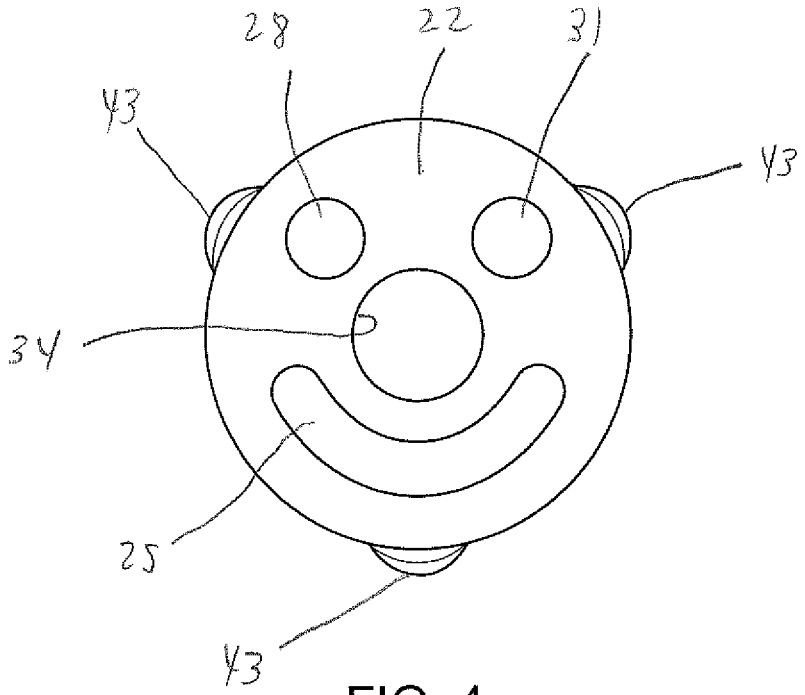
FIG. 4 is a bottom plan view thereof.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read together with the specification, and are to be considered a portion of the entire written description of this invention.

Referring to FIGS. 1-5 generally and initially to FIG. 1, a sensory tool 7 has an elongate body 10 that extends in a longitudinal direction 13 from a proximal end 16 to a distal end 19. The elongate body 10 may be formed out of any suitable rigid material such as plastics or the like. The elongate body 10 may be molded from a thermoplastic or any other suitable material. The proximal end 16 has a surface 22 (FIG. 2) facing in the longitudinal direction 13. The surface 22 has at least one protuberance 25 extending therefrom in the longitudinal direction. The surface 22 may be provided with additional protuberances 28, 31 (FIG. 5) that may form a fanciful design such as a "smiley face." The surface 22 may also be provided with an opening 34 (FIG. 4) defined therein. The surface 22 has at least one protuberance extending outward therefrom in the longitudinal direction 13 or at least one recessed portion extending inward in the longitudinal direction 13.

The distal end 19 of the elongate body 10 has a surface 40 disposed thereon. The surface 40 may face in the longitudinal direction.

The elongate body 10 may also have a midportion 43 disposed between the distal end 19 and the proximal end 16. The midportion 43 may be provided with a generally triangular shape in cross-section (best shown in FIG. 3). The triangular cross-section may be provided with rounded corners. And the midportion 43 may be provided with planar surfaces 44 on each side of the triangular shape. The midportion 43 may be provided with a plurality of recessed portions 52. Alternatively, the midportion 43 may be provided with a plurality of protuberances extending from the surface such as ribs or the like or other tactile members. Other tactile elements such as suction cups may also be disposed on the elongate body 10.

The elongate body 10 may be provided with a distal portion 46 extending between the midportion 43 and the distal end 19. The distal portion 46 has a diameter that may gradually decrease from the end 49 of the midportion 43 to the distal end 19. The distal portion 46 may include an inwardly curved outer surface 55 extending from the midportion 43 to the distal end 19. The distal end 19 may be round with a flat surface 40 disposed thereon. The distal portion 46 may include three outer surfaces with each surface curving inward from the midportion 43 to the distal end 19. When the tool 7 is initially grasped by the distal end 19 and pressed into the putty 66, the curvature causes the hand of the user 76 to slide onto the midportion 43.

The elongate body 10 may be provided with a proximal portion 58 disposed between the midportion 43 and the proximal end 16. The proximal portion 58 may be substantially round in cross section (best shown in FIGS. 3-4). The proximal portion 58 may be substantially cylindrical and the cylinder may extend to the proximal end 16.

The elongate body 10 may also be provided with an internal cavity for receiving electromechanical (i.e., battery or sensor component) elements such as a vibratory component. A power source for the vibratory component such as a battery or the like may also be contained within the elongate body 10.

The elongate body 10, the outer surfaces of the elongate body 10, and the distal and proximal ends 19, 16 of the tool 7 make up the primary parts of the invention in its preferred form. The tool 7 works best with thermoplastic resistive putty to achieve desired tactile and graded pressure response and enhance sensory motor/learning muscle memory and muscle strengthening. The tool 7 can be used with all forms of putty 66 (FIG. 5), as the situational use may dictate. For example, the tool 7 can be used with an extra soft or soft therapy putty (or non-therapy putty of similar resistance) when exercises are targeted for the 3-5 year old population.

The tool 7 may be configured with a triangular prism shaped elongate body 10 having ribs (running horizontal or vertical, either protrusions or depressions in the prism) in the surface, which facilitate tactile feedback when pinching the tool 7 with use of the distal thumb, index and middle finger on a user's hand (the "tripod grasp"). A circular impression 34 on the underside of the putty tool 7 allows for the user to make a "plug of putty" impression into the putty. The distal end 19 of said putty tool 7 allows for isolating a point to impress in a pressed-out putty plug. A proximal end 16 of the tool 7 allows the user to stamp a plug of putty with the impression of the stamp. For example, a stamper end may have a smiley face configuration, with "nose" of the smiley face being a plug of putty when an impression is made.

The harder the worker side of the user's hand (thumb, index and middle fingers pinching) press on the tool 7 to push into the putty 66, the higher the plug of putty thus increasing the sensory appeal to "push in" by one or more fingers.

The triangular shape of the tool 7 adds stability to the tool 7 and increases the chance a user intuitively pinches the tool 7 using intrinsic muscles (smaller) vs. extrinsic muscles (larger) of the hand in a tripod grasp (use of thumb, index and middle fingers, similar to an efficient pencil grasp). If a user were to grasp the distal end 19 of the putty tool 7, the shape of the distal end 19 still promotes the three point (thumb, index and middle fingers) prehension pattern.

The tactile features of the peg tool 7 are appealing sensory components of the tool 7 within the hand (ribbing). The tool 7 can also be grasped by its side surfaces to promote a three point prehension pattern (i.e. to impress ribbed sides into putty). Impressions made by the tool 7 into the putty 66 are appealing sensory components of the combination of the putty 66 and the tool 7.

Stamper impressions into the putty 66 using the tool 7 may be used in a new therapeutic and educational way. A tool 7 hidden within the putty 66 and in conjunction with the putty 66 may be used in a new way. The shape of the tool 7 lends itself to developing the proper muscles needed to develop a functional grasp (specifically for children, a tripod grasp, for holding a pencil and other implements, efficiently) . Impressions made by indentations in putty 66, the shape of the tool 7 (like a small pencil) and use of a putty board 70 (FIG. 5) encourages use of isolated finger movements necessary for promoting efficiency in common functional tasks (e.g. depressing keys of a keyboard, drawing). For the 3-5 year old population, the tool 7 is preferably small (approx. 40 mm to 64 mm) to develop the small muscles of the kid's hands. A triangular putty tool 7 could vary in size to use with putty 66, but a smaller-sized tool 7 develops small muscles of the fingers/arches and separation of sides of the hand to prepare the hand for school tasks.

A tool 7 that is pushed into putty 66 may be used to strengthen muscles and simulate common functional tasks.

The tool 7 being hidden in the putty 66 facilitates pinch and grasp strength as an individual needs to use digit/hand strength to both find the tool 7 and hide the tool 7.

The tool 7 is preferably combined with putty 66 to make use of some of the methods described herein. The putty tool 7 needs the putty 66 to make impressions into putty 66 (with peg surfaces used as stampers). The tool 7 itself is therapeutic in terms of its tactile and shape features. The tool 7 lends itself to promote a tripod grasp by the user, as its triangular surface makes such grasp very intuitive. The smiley-face surface at the proximal end 16 makes impressions into the putty 66, which makes it appealing and motivating for children's exploration with their hands.

The tool 7 is designed in a triangular shape so that the elongate body 10 of the tool 7 needs to be pinched intuitively with a tripod grasp vs. an instinctive tendency for a child to grasp just the "top" of the tool 7. The smaller triangular shaft surface forces the intrinsic muscles of the hand to develop vs. a larger surface area of a larger tool 7.

A pointed end surface allows for depression into putty to simulate writing tool movement, to trace circular impression made into putty, as well as to depress directly into putty thus allowing for development of eye hand coordination. With this method, the putty may be used as a "paper surface" and the tool 7 may be used as a "writing tool."

The shape of the tool 7 provides that when surface ribbed triangular midportion 43 of the tool 7 is grasped, it will be intuitive to hold with a 3 point grasp—thumb, index and middle finger tips.

Figure 5:
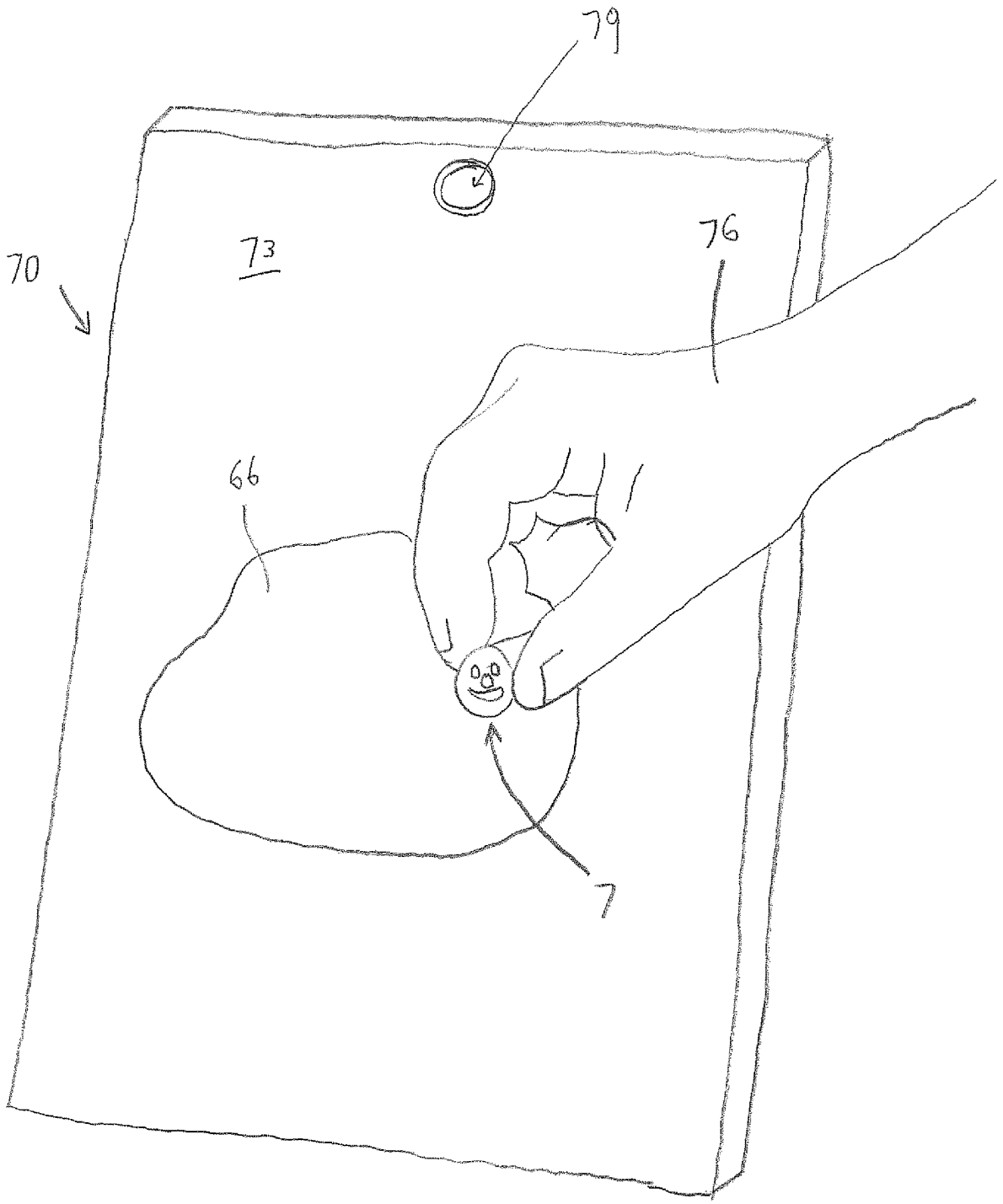
FIG. 5 is a perspective view of the sensory tool, putty, and board in use.

Turning to FIG. 5, a putty board 70 may any size, including, for example, 5"×5", 8.5×11" or 9"×12" (in various shapes, not only square or rectangular). The putty board 70 has a nonskid material, and is large enough for the performance of exercises on the putty board surface 73. The putty board 70 may have various textures, numbers, letter shapes, boxes, lines and play themes to enhance engagement with putty/putty use and sensory and learning experience.

The putty tool 7 is preferably made of a material that gives it structural strength and will not stick to the putty 66. A hollow tool 7 may fill up with putty, so it is preferred that the tool 7 not be hollow. The putty 66 to be used with tool 7 may be thermoplastic putty or any other putty material. While Play Doh or modeling clay may be used, these substances may stick to the tool, and are not preferred. Plastic at this time seems to be a preferred material for the putty tool 7 due to its need for stability and nonstick surface, though any suitable material could be used.

The tool 7 is preferably solid in its configuration in order to withstand forces of manipulation by a user.

The tool 7 may have a member surface for gripping, and a stamper surface for areas which are to be pressed into putty 66 to make impressions.

Stamper configurations of various types could be screwed or snapped into ends of the tool 7 or to on to sides of the tool 7 to allow a user to create other impressions into the putty 66. The tool 7 could be configured with different integral stamper impressions and ends. The tool 7 could be made larger or smaller with various surface impressions, shapes and stamper angles and surfaces. The tool 7 could accommodate a battery and various tactile features to allow for further sensory input and feedback. Larger tools 7 may be used to accommodate larger children and adults.

An inner vibratory component may be added inside the tool (e.g. a battery/vibratory component) to allow for further sensory input/feedback and motor memory grip and pinch/fine motor skill and dexterity development. The addition of a suction cup surface also allows for another tactile/sensory and strengthening feature. Various tactile surface components may be added to the surfaces of the tool 7 to allow for further grasp and pinch development and various uses for uniquely functional tasks. For example, the use of a stylus requires efficient grasp and specific gradation of pressure, the use of a mouse pad and keyboard requires rotary, depression and adduction/abduction movements of various digits, as well as web space and in-hand arches of the hand and skilled side/worker side of the hand, and to allow for bilateral hand use. Wrist stabilization and an open web space are crucial developmental hand skills young children (and those of all ages recuperating from a hand injury/trauma/deconditioning) must develop to allow for optimal fine motor/dexterity skills.

Various stampers with letters, numbers and special interests designs to could be added to the tool to add to the educational value of the tool. Stampers of various textures could be added to the tool to allow for individualized sensory input.

Putty board 70 may also include a variety of tactile features to enhance the sensory experience of the putty 66 pressed onto the surface 73 and the impressions made into putty 66 are visually and sensory appealing. Various shapes, numbers, letters and maze/game features and play theme tactile features could create impressions into putty 66 that could then be traced and/or putty 66 could be molded to fit into the various features on the board 70 for fine motor development, learning and sensory enhancement.

The putty board 70 may be 8.5×11 (book size) and weighted to provide sensory/heavy work input for an aid to self-regulation when used on lap. Combined with putty 66/putty tool 7, this provides heavy work input for enhanced self-regulation. Users can control amount of heavy work input when used in this capacity.

The ribs of the tool 7 could be left out on the sides of the tool 7 or substituted with other gripping texture/indentations. The smiley face (two eyes and mouth bump outs) could be left out or modified to create an alternative stamper impression.

The tool 7 can be used as an in-hand fidget tool/self-regulation tool according to the methods described here aside from the focus being on a fine motor/grasp strengthening tool (though this is still an added benefit). Tool 7 can be used as an educational tool to enhance learning with the pointer end of the tool 7 simulating the actions of a writing utensil and the putty 66 simulating the actions of paper.

The tool 7 can be used in creative/imaginative play, and as a self-expression and stress reduction/anxiety reduction tool when used with putty 66. The tool 7 as a sensory tool for self-regulation providing heavy work input for small muscles of the hand.

The tool 7 can be used as a learning tool. For example, marker letters or numbers could be imprinted onto bubble wrap and users could use the tip point of the peg tool to "pop" out the air bubbles of the wrap. Users can also use the pointer tool of the tool 7 to poke holes through a variety of surfaces (e.g., when styrofoam is used as a board surface for material) as a fine motor strengthening activity.

Although motor movements could be practiced using the putty tool 7 alone (e.g. to simulate a functional skill such as typing or playing an instrument or holding a stylus/writing instrument or as a sensory/tactile self-regulation tool), it will not work in its best form unless used with putty 66 to allow for the unique tactile, strengthening and sensory, motivational experience it creates.

The tool 7 can be used with any form of resistive thermoplastic putty 66, or silicone based putty. The putty 66 can be made of any material that is strong and does not stick to the tool 7 and allows for basic impressions to be made into the putty 66.

The putty board 70 may be a 15×20 cm. high density polypropylene board with a nonskid surface for performing putty 66 exercises using the tool 7. The thickness of the putty board 70 may be approximately 6 cm but could be as thick as 16 cm. A hole 79 in the putty board 70 allows for carrying of board 70 as well as hanging on a hook (not shown).

The use of a putty board 70 enhances performance of the putty tool 7 as it allows for positioning of the board 70 against the wall, on the floor or on the underside of a table to enhance optimal wrist extension position. Wrist extension posture facilitates an open web space within the hand. Wrist stability is the foundational base of support for distal digit mobility.

The putty hoard 70 may have tactile and features to enhance sensory and learning experience. The putty board 70 may have a hole for hanging, or students can hold the board 70 with their helper hand while their worker hand works to enhance development of hand dominance and bilateral coordination skills.

The putty tool 7 develops a tripod grasp, pincer prehension pattern/pinch strength, grasp and pinch strength, isolated digit movements and thumb movements in all planes, develops separate sides of the hand, develops web space, and arches in the hand when used with the resistive putty 66. The nature of the putty plug created by the tool 7 can be useful in facilitating gradation of pressure necessary for transferring over to functional tasks (such as writing, coloring, keyboarding, use of a pressure touch screen/pad or stylus, mouse pad surface, fine motor/dexterity skills needed for childhood manipulation of fasteners, various container closures, and general tool and material use) or when writing.

Imprints onto putty 7 facilitate learning by reproducing common paper writing boundaries that work needs to be made within (lines, boxes) as well as creating a tactilely appealing plug and surface that lends itself to a small hand wanting to take their index finger and squishing.

Using hands to grasp a tool 7 and pushing into putty 66 can develop strength and fine motor dexterity. The disclosed putty tool 7 facilitates correct tool hold (use of thumb, index and middle finger in a tripod grasp on shaft of tool) and correct in-hand movements by performing various specific hand exercises with the tool 7; the specific surface features of the tool 7 encourages pinching (resistive) as well as creates putty plugs that encourage graded, resistive depression by individual digits and thumb as well as develops in hand, wrist and forearm musculature.

Many creative tool exercises may be performed using the tool 7 and putty 66 of the present invention. The exercise may include, but are not limited to, the following steps.

Peg Tracks—form a mass of putty into the shape of a pancake on the board—turn the tool on its side and roll onto the putty pancake with index and middle fingers pointed up.

Peg Push—hold a ball of putty in fisted grasp—extend thumb up and then down on smiley face to push the tool (pointy side down) into the putty with thumb tip.

Peg Around—create putty pancake—place tool face into putty—turn tool in both directions.

Peg Volcano—make another putty pancake—place base of tool into middle of pancake—use helper hand to hold down putty while worker hand fingers and thumb pull tool and putty up.

Peg Candle—make putty pancake—pull off pea size amount of putty to roll into ball with thumb, index and middle fingers of worker hand—place tool point side down in pancake and place ball on top—smell the flower and blow out the candle.

Peg Cone—lift up candle (tool with pea sized ball on top) with same three digits to hold like a mini ice cream cone.

Peg O!—make a putty pancake-use pointy end of tool to make a dime sized circle in center of pancake. Insert fingertips and thumb into hole and stretch out hand to make a larger "O".

Peg Poke—make a putty pancake. Stamp smiley face into pancake. Take a "dip" with index finger into "nose" to flatten. Try same movements with other fingers and thumb.

Peg a Nose!—make putty pancake—make a face into putty then rotate (or turn) tool to pointy end to make a dot in the nose of face.

Peg Race—make as many faces as possible into putty pancake. Turn tool to pointy side and with tip make as many noses as you can!

Peg in a Blanket—remove dime sized amount of putty. Roll between hands to make a small snake (approx. 3"). Lay small snake down to make a #1. Place tool on its side at the bottom of the #1, Take thumb, index and middle fingers of both hands to roll up the putty onto the tool.

Peg Hide and Seek—Outstretch hand palm up and place tool at base of ring and pinky finger. Bend pinky and ring fingers down to "hide" tool. Slowly straighten ring and pinky fingers to "find" tool. Challenge: try moving tool from ring and pinky fingers to thumb, index and middle fingers.

Peg Power—hold tool and putty in the palm of your hand; close fist and squeeze; breathe in through your nose, hold for one second, breathe out through pursed lips as you squeeze.

Peg Peace—make peace sign "bunny ears"; trace fingers with tool; breathe in through your nose, hold for one second, breathe out through pursed lips as you trace each finger.

Peg Pull—pull each end of the tool as hard as you can.

Peg Sunny-Side Up—Use your ring finger and pink to hide the tool; use your same hand to move the tool up to your middle and index fingers.

The components of the system including the tool 7, the putty 66, and the board 70 may be provided with electric, pressure sensing circuits to determine the force exerted by the user 76 on the components. The measurements taken may be displayed in a color coded system with green/yellow/red indicator lights corresponding to the levels of force being sensed. The green signal provides an indication that more force may be applied. A yellow sensor indicates that the force is reaching a predetermined threshold and a red sensor provides a warning to reduce the force. The system may provide sensor feedback for all surfaces of the tool and board. An electrical circuit may also be embedded in the putty 66.

The system may also be combined with biofeedback technology such as surface electromyography (SEMG) which is a non-invasive, computer based technique that records the electrical impulses using electrobodies placed on the surface of the skin overlying the nerve at rest (i.e., static) and during activity (i.e., dynamic).

The system may also be combined with a computer application for use with a device such as a cellular phone, tablet or the like. The tool 7 or the surface of the device may be pressure sensitive to provide feedback for self-regulation. The end of the tool 7 may be provided with rubber type stylus tip for use with a screen on a device.

The present invention contemplates that many changes and modifications may be made. Therefore, while the presently-preferred form of the system has been shown and described, and several modifications and alternatives discussed, persons skilled in this art will readily appreciate that various additional changes and modifications may be made without departing from the spirit of the invention, as defined and differentiated by the following claims.

What is claimed is:

1. A sensory tool for use with therapy putty, comprising: an elongate body extending in a longitudinal direction from a proximal end to a distal end, the proximal end having a surface facing in the longitudinal direction, the surface at the proximal end having at least one protuberance extending outward therefrom in the longitudinal direction or at least one recessed portion extending inward therefrom in the longitudinal direction, the distal end of the elongate body having a surface disposed thereon, the surface facing in the longitudinal direction, the elongate body having a midportion disposed between the proximal end and the distal end, the midportion being triangular in cross-section, the midportion having a plurality of ribs disposed thereon, the elongate body having a distal portion extending between the midportion and the distal end, the distal portion having a diameter that decreases between the midportion and the distal end.

2. The sensory tool of claim 1, further comprising a proximal portion disposed between the midportion and the proximal end, the proximal portion being round in cross section.

3. The sensory tool of claim 2, wherein the proximal portion is cylindrical and extends to the proximal end.

4. The sensory tool of claim 1, wherein the midportion has a plurality of recessed areas disposed thereon.

5. The sensory tool of claim 1, wherein the distal portion has an inwardly curved outer surface extending from the midportion to the distal end.

6. The sensory tool of claim 1, wherein the distal end is round.

7. The sensory tool of claim 1, wherein the at least one protuberance comprises a plurality of protuberances that form a smiley face design when the sensory tool is pressed into the therapy putty.

8. The sensory tool of claim 1, wherein the distal portion comprises three surfaces with each of the three surfaces curving inward from the midportion to the distal end.

9. The sensory tool of claim 1, wherein the midportion is triangular in cross section with the corners of the triangle being rounded.

10. The sensory tool of claim 1, further comprising an inner vibratory component disposed inside the elongate body.

11. The sensory tool of claim 1, further comprising a suction cup surface disposed on the elongate body.

12. A sensory tool kit, comprising:

a sensory tool having an elongate body extending in a longitudinal direction from a proximal end to a distal end, the proximal end having a surface with an opening defined therein, the surface facing in the longitudinal direction, the surface having at least one protuberance extending outward therefrom in the longitudinal direction or at least one recessed portion extending inward therefrom in the longitudinal direction, the distal end of the elongate body having a surface disposed thereon, the surface facing in the longitudinal direction, the elongate body having a midportion disposed between the proximal end and the distal end, the midportion being triangular in cross-section, the midportion having a plurality of ribs disposed thereon, section and a distal portion extending between the midportion and the distal end, the distal portion having a diameter that decreases between the midportion and the distal end;

a therapy putty capable of deforming when the sensory tool engages the therapy putty with a sufficient force; and, a putty board having a surface disposed thereon for supporting the therapy putty during engagement with the sensory tool.

13. A method of using a sensory tool, comprising:

providing a sensory tool having an elongate body extending in a longitudinal direction from a proximal end to a distal end, the proximal end having a surface with an opening defined therein, the surface facing in the longitudinal direction, the surface having at least one protuberance extending outward therefrom in the longitudinal direction or at least one recessed portion extending inward therefrom in the longitudinal direction, the distal end of the elongate body having a surface disposed thereon, the surface facing in the longitudinal direction, the elongate body having a midportion disposed between the proximal end and the distal end, the midportion being triangular in cross-section, the midportion having a plurality of ribs disposed thereon, and a distal portion extending between the midportion and the distal end, the distal portion having a diameter that decreases between the midportion and the distal end;

providing a therapy putty capable of deforming when the sensory tool engages the therapy putty with a sufficient force; and, providing a putty board having a surface disposed thereon for supporting the therapy putty during engagement with the sensory tool.

14. The method of claim 13, further comprising the step of wrapping the therapy putty around the sensory tool.

15. The method of claim 13, further comprising the step of inserting the sensory tool into a mass of the therapy putty.

16. The method of claim 13, further comprising supporting the therapy putty on the putty board and pressing the proximal end of the sensory tool into the therapy putty.

17. The method of claim 13, further comprising supporting the therapy putty onto the putty board, pressing the sensory tool into the therapy putty such that a recessed portion formed in the midportion of the sensory tool forms a set of track-like impressions in the therapy putty.

18. The method of claim 13, further comprising supporting the therapy putty on the putty board and pressing the distal end of the sensory tool into the therapy putty.

19. The method of claim 13, further comprising supporting the therapy putty on the putty board, pressing the proximal end of the sensory tool into the therapy putty to form an impression and pressing the distal end of the sensory tool into a portion of the impression made by the proximal end.

20. The method of claim 13, wherein the putty board is 8.5 inches by 11 inches.

21. The method of claim 13, wherein the putty board comprises tactile features to enhance the sensory experience of the therapy putty being pressed onto the surface of the putty board and the impressions made in the putty being visually and sensory appealing.

* * * * *